US010143321B2

(12) United States Patent
Hippert

(10) Patent No.: US 10,143,321 B2
(45) Date of Patent: Dec. 4, 2018

(54) FOLDABLE AND COLLAPSIBLE SAFE BOX FOR SECURING PACKAGE DELIVERY

(71) Applicant: Ryan Hippert, Houston, TX (US)

(72) Inventor: Ryan Hippert, Houston, TX (US)

( * ) Notice: Subject to any disclaimer, the term of this patent is extended or adjusted under 35 U.S.C. 154(b) by 216 days.

(21) Appl. No.: 15/204,834

(22) Filed: Jul. 7, 2016

(65) Prior Publication Data

US 2017/0188737 A1 Jul. 6, 2017

Related U.S. Application Data

(60) Provisional application No. 62/274,696, filed on Jan. 4, 2016.

(51) Int. Cl.
*A47G 29/20* (2006.01)
*A47G 29/30* (2006.01)

(52) U.S. Cl.
CPC ..... *A47G 29/20* (2013.01); *A47G 29/30* (2013.01)

(58) Field of Classification Search
CPC ..... A47G 29/20; A47G 29/30; A47G 29/124; B65D 11/18
USPC ..... 232/19, 38, 17, 45; 220/4.28, 4.29
See application file for complete search history.

(56) References Cited

U.S. PATENT DOCUMENTS 1,673,769 A * 6/1928 Graham ..... G07C 13/02 220/6
1,847,969 A * 3/1932 Marks ..... A47G 29/20 232/42
4,714,013 A * 12/1987 Telfer ..... F24C 1/16 126/9 R
5,624,071 A * 4/1997 Sosan ..... A47G 29/20 232/1 B
6,155,715 A * 12/2000 Lake ..... A47G 29/20 150/102
6,204,763 B1 * 3/2001 Sone ..... A47G 29/141 221/2
6,375,070 B1 * 4/2002 Snoke ..... A47G 29/141 232/20
6,426,699 B1 * 7/2002 Porter ..... A47F 10/00 221/2
7,175,071 B1 * 2/2007 Slagle ..... A47G 29/16 220/833
D574,124 S * 7/2008 Huber ..... D99/28
9,364,112 B2 * 6/2016 Sundaresan ..... A47G 29/124
9,596,952 B2 * 3/2017 Mencel ..... A47G 29/20
9,873,549 B2 * 1/2018 Heinz ..... B65D 21/086
9,926,108 B2 * 3/2018 Wiley ..... B65D 33/00
2012/0269461 A1 * 10/2012 Proctor ..... A47G 29/20 383/64
2013/0077896 A1 * 3/2013 Wiley ..... B65D 33/00 383/86.2
2015/0305538 A1 * 10/2015 Sundaresan ..... A47G 29/124 232/36
2016/0051073 A1 * 2/2016 Heinz ..... A47G 29/141 232/39

(Continued)

*Primary Examiner* — William L Miller
(74) *Attorney, Agent, or Firm* — Frank Huy Pham; Pham IP Group

(57) ABSTRACT

A foldable and collapsible safe box for securing packages or parcels is constructed to include a collapsible safe box body of rectangular shape having a horizontal top open side, a plurality of upright support elongated hinges respectively embedded in four corners of the box body, a horizontal cover flap for securing the box, and a horizontal bottom panel for supporting the contents inside the box.

6 Claims, 4 Drawing Sheets

(56) References Cited

U.S. PATENT DOCUMENTS

| | | | | |
|---|---|---|---|---|
| 2016/0068306 | A1* | 3/2016 | Heinz | B65D 21/086 220/560.01 |
| 2016/0309939 | A1* | 10/2016 | Mencel | A47G 29/20 |
| 2017/0055751 | A1* | 3/2017 | Sundaresan | E05B 73/0011 |
| 2017/0127868 | A1* | 5/2017 | Adewuyi | A47G 29/124 |

* cited by examiner

FOLDABLE AND COLLAPSIBLE SAFE BOX FOR SECURING PACKAGE DELIVERY

CROSS-REFERENCE TO RELATED APPLICATION

The present application is based on, and claims the benefit of priority of U.S. application Ser. No. 62/274,696, the disclosure of which is hereby incorporated by reference herein in its entirety.

BACKGROUND OF THE INVENTION

1. Field of the Invention

The field of the invention relates to a safe box and, more particularly, to a foldable and collapsible safe box releasably connected to a front door of a residence for securing package or parcel delivery when the homeowners are not present.

2. Description of the Prior Art

The delivery and pick-up packages or parcels are common business activities at residential homes as online commercial transactions are increasing. When there is no one present to receive the packages or parcels, it is not a good safe practice to leave the packages or parcels at the front door as they are often stolen. Furthermore, valuable goods or articles should not be left at a temporarily unattended residence without any means of security.

Various prior arts specifically address this problem. Some safe boxes for packages are either simply placed outside with no securing or are permanently secured to the wall outside of the house. Other safe boxes are too heavy so they cannot be carried away with the package inside. The permanent ones require tools and some sort of handyman ability.

In an existing prior art, a secure box or safe having a mounting plate with a channel-shaped flange at the top such that the safe may be hung from the top edge of an outer door of a residence and, when the door is closed, the safe is captured in place between the top of the door, the door head, the outside surface of the door, and the door stop. While this safe box is relatively secured, hanging the box over the door causes the box to rest against the door and therefore damages the door when the box to be detached or reattached to get the package in or out. In addition, because this safe box is strictly designed and used for small items not large packages or parcels as the safe is hung on the top of the door, it cannot support such heavy weights.

Another existing prior art of a security box for articles is mounted over the edge of an outer of residence door by means of a bracket which fits around the door edge. The interior of the box is accessible by opening a locked and hinged outer panel which uncovers an outer access opening. However, the box is easy to break or pry off the hinges, and it is not a complete weather-tightened container as rain water could easily seep through the outer access opening and soak the packages or parcels inside the box. Also, water running down the surface of the door can easily enter the box through the inner access opening.

Further, these conventional safe boxes occupy much storage space as they are not foldable or collapsible. There is known a folding collapsible storage box, which comprises a collapsible fabric box body, four horizontal rod members respectively embedded in the top sides of the four vertical side panels of the box body, two horizontal rod member respectively embedded in the bottom sides of two opposite vertical side panels of the box body, four vertical rod members respectively embedded into the box body in four corners between each two adjacent vertical side panels, and four sets of triangle plates respectively fixedly fastened to the vertical side panels of the box body. When not in use, the box body is twisted into a collapsed condition. The triangle plates guide the twisting action, enabling the box body to be easily twisted into the collapsed condition. Although this structure of folding collapsible storage box is functional, it is too complicated and expensive to manufacture. Further, because the box is constructed by fabric, it is not secured as the box can be cut with a scissor or knife.

Therefore, a need exists in the art for a folding collapsible combination safe box for securing packages or parcels to overcome these problems and is simple and inexpensive to manufacture.

SUMMARY OF THE INVENTION

The present invention provides a foldable and collapsible safe box for securing packages or parcels but is removably attached to a front door of a residence and securely accessible to both a delivery person and the homeowners or occupants.

It is one object of the present invention to provide a foldable and collapsible safe box, which can easily be folded into a collapsed flat manner to minimize storage occupation. It is another object of the present invention to provide a combination of foldable and collapsible safe box, which is simple and less manufacturing cost.

In a preferred embodiment of the present invention, the foldable and collapsible safe box comprises a collapsible box body of rectangular shape having a horizontal top open side, a plurality of upright support hinges respectively embedded in four corners of each collapsible box body, and a bottom panel of the collapsible box body for supporting storage items. Being formed of water sustainable material such as plastic, this safe box body is weather proof.

In a further preferred embodiment of the present invention, the foldable and collapsible safe box body has a cover flap pivotally attached to the upper portion of the foldable and collapsible safe box by hinges for opening and closing cover flap on a side of the respective box body. The hinges can be selected from a group of double hinges, snap-on hinges, butt hinges, pivot hinges, or any suitable hinges. According to still another aspect of the present invention, the cover flap has a releasably locking means so that the box can be accessible to a delivery person and residents by unlocking the locking means for loading or unloading the packages or parcels.

In a further preferred embodiment of the present invention, the bottom panel is a hard base plate respectively fitted into the foldable and collapsible safe box and supported on the horizontal bottom panel of each collapsible box body for supporting storage items. The bottom panel is pivotally attached by hinges to the lower portion of the foldable and collapsible safe box by hinges for opening and closing the bottom panel on a side of the respective box body. The hinges can be selected from a group of double hinges, snap-on hinges, butt hinges, pivot hinges, or any suitable hinges. According to an aspect of the present invention, the bottom panel includes releasably locking means so that the box can be foldable and collapsible. The releasably locking means of the bottom panel is a releasably latch such as spring loaded latch having spring, latch pin, and latch cover plug.

In a further preferred embodiment of the present invention, there is a mounting base plate releasably and extensibly attached to the foldable and collapsible safe box body at the bottom thereof by an outer flange that grips the back of a vertical peripheral side panel of the box body. This mounting base plate is also slidably engaged under an outer door of a residence by a channel-shaped flange which fits closely around an edge of the door to securely mount the box body so that when the door is closed, the mounting base plate is captured in place between the bottom of the door and door step. The channel-shaped flange has a soft pad such as rubber, felt, or any suitable material to prevent damages to the door by contact.

The present invention has been accomplished under the circumstances in view. It is one object of the present invention to provide a foldable and collapsible safe box, which can easily be folded into a collapsed flat manner to minimize storage occupation. It is another object of the present invention to provide a foldable and collapsible safe box, which is simple and inexpensive to manufacture.

Further objects and advantages of the present invention will become apparent from a description of the several embodiments as set forth in the following description and drawings.

DETAILED DESCRIPTION OF THE INVENTION

Figure 1:
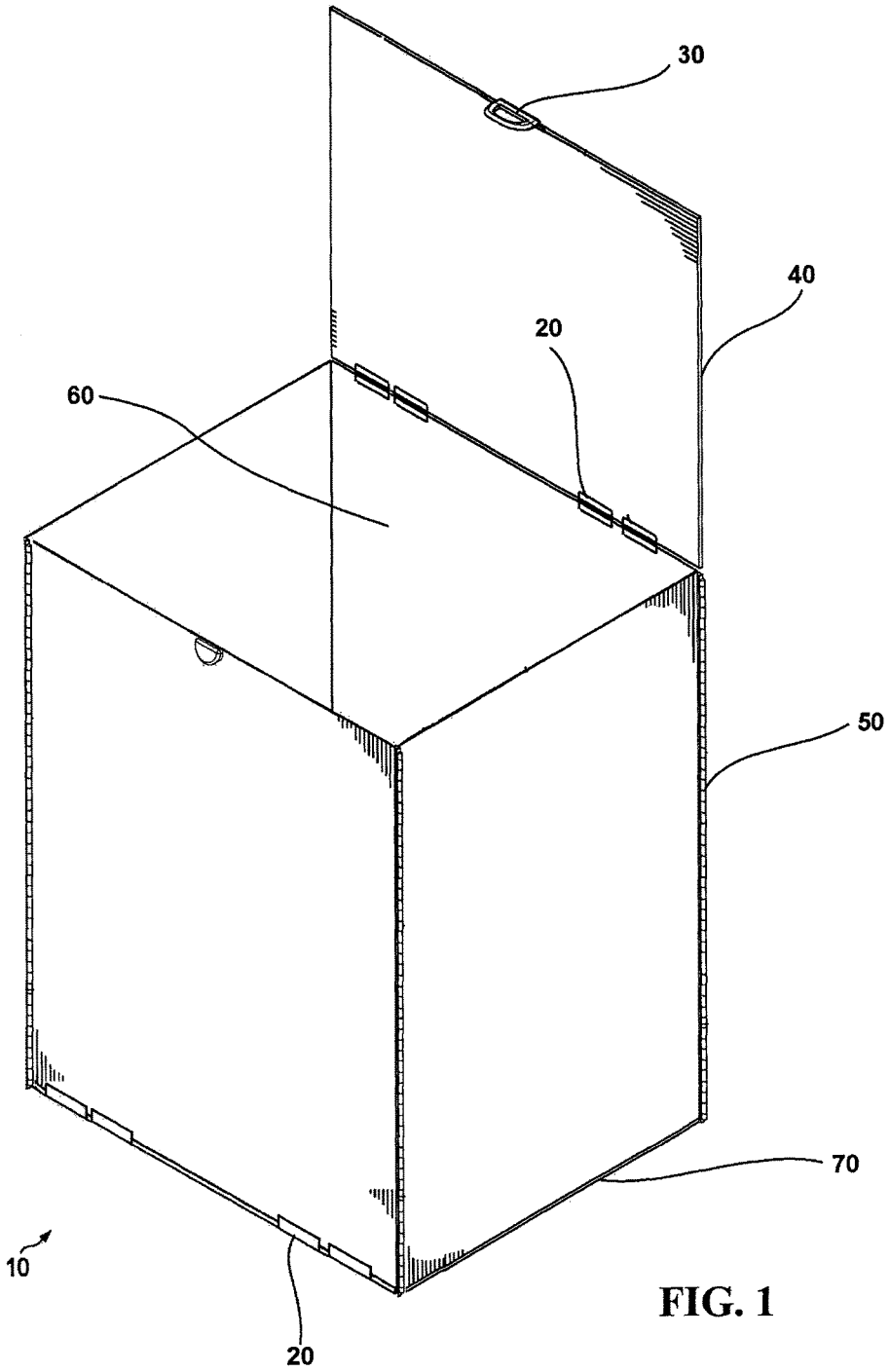
FIG. 1 is a perspective view of a foldable and collapsible safe box constructed according to an embodiment of the present invention where the cover flap is lifted.
Figure 6:
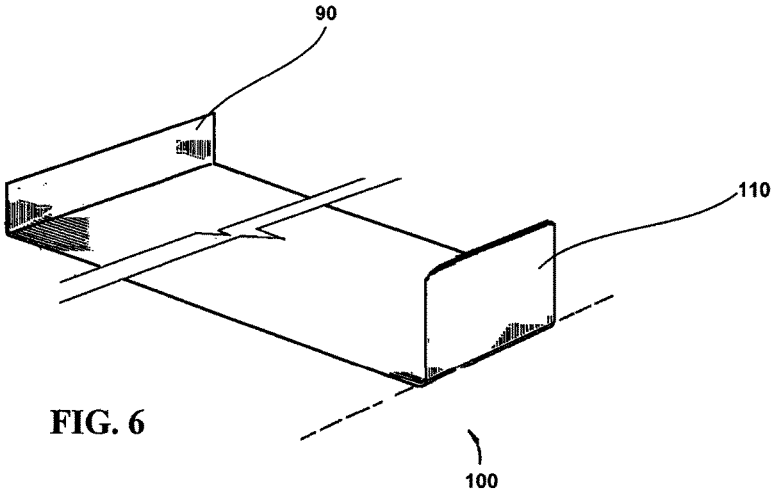
FIG. 6 is a perspective view of a mounting base plate constructed according to an embodiment of the present invention.

FIG. 1 illustrates a foldable and collapsible safe box in accordance with the embodiment of the present invention comprising of a rectangular box attached to a cover flap 40 and a bottom panel 70. According to an embodiment, the box body 10 comprises four upright elongated hinges 50, and a mounting bracket plate 100 as shown in FIG. 6. The foldable and collapsible safe box body 10 is formed of plastic, metal, and any material suitable, having four vertical peripheral side wall panels and a horizontal bottom panel side open 70 and a cover flap 40 opening on the side. The four upright support hinges 50 are embedded into the four corners of the box body 10.

Figure 4:
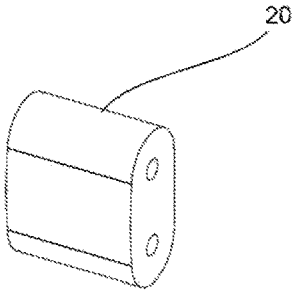
FIG. 4 is a perspective view of a double hinge constructed according to an embodiment of the present invention.

Still referring to FIG. 1, the cover flap 40 is at the top of the box body 10 and pivotally secured to the back wall panel 60 of the box body 10 by the use of double hinges 20 shown in FIG. 4 about a horizontal axis between both ends of the back wall panel 60. The cover flap 40 is locked to the box body 10 by the use of a locking means 30 to secure the contents inside. The locking means 30 can be unlocked by a delivery person or the occupants loading or unloading the contents of box body 10.

Figure 2:
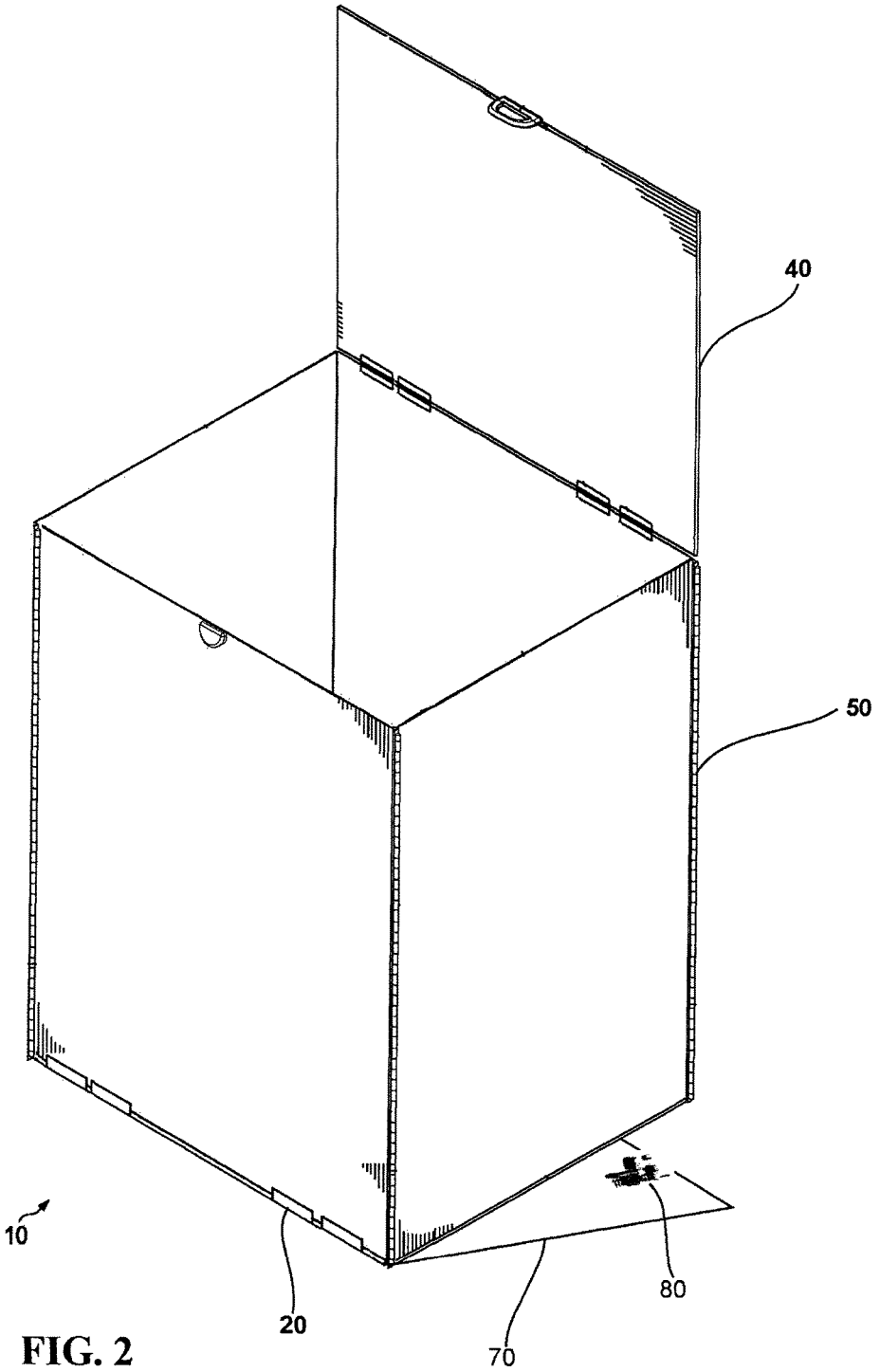
FIG. 2 is a perspective view of a foldable and collapsible safe box constructed according to an embodiment of the present invention where the cover flap is lifted and bottom panel with the spring loaded latch is opened.

FIG. 2 illustrates the bottom panel 70 pivotally secured to the front wall panel by the use of double hinges 20 attached to the box body 10. The bottom panel 70 is releaseably attached via spring loaded latches 80 to the back wall 60 as shown in FIGS. 1 and 2.

Figure 3:
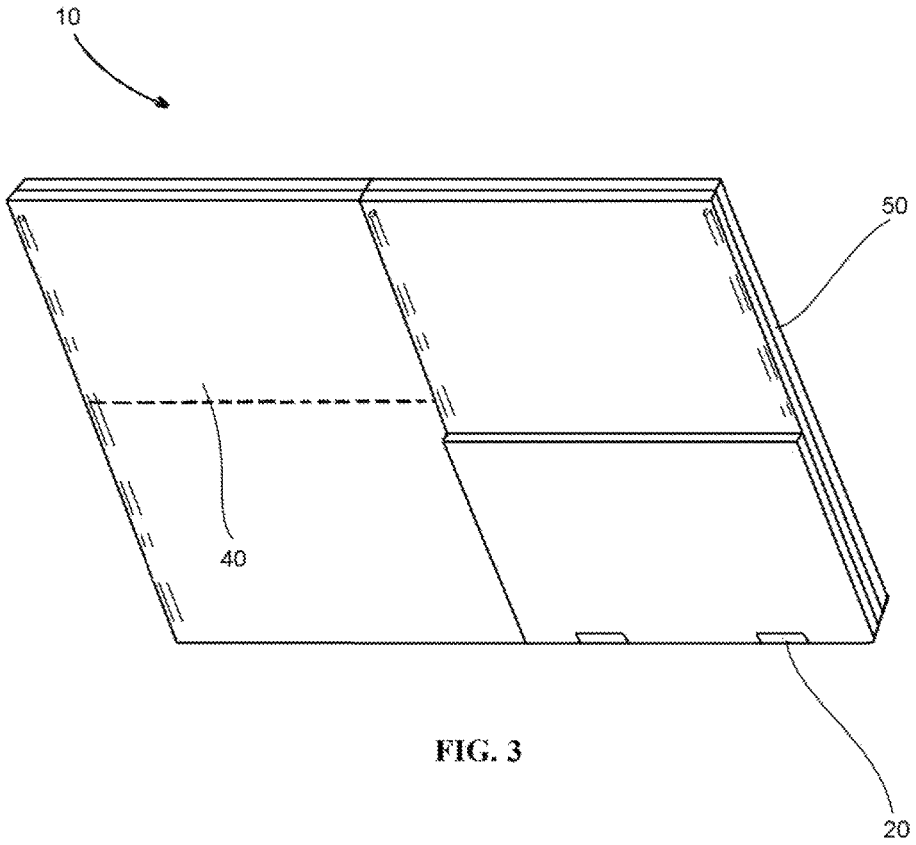
FIG. 3 shows the collapsing action of the embodiment of the present invention where the box is folded to the collapsed manner.

Referring to FIGS. 3 and 4 and FIGS. 1 and 2 again, when not in use, the bottom panel 70 of the box body 10 is respectively lifted from horizontal to vertical and closely attached to one vertical peripheral side panel of the respective box body 10, and then the box body 10 is folded through 90 degree and arranged into a collapsed flat manner as shown in FIG. 3. When folded up, the box body 10 occupies little storage space and is convenient for carrying with the hand.

Figure 5A:
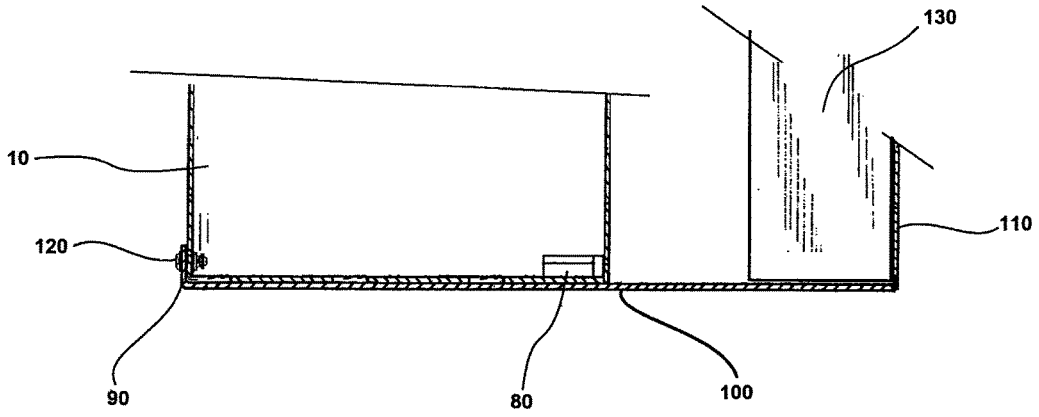
FIG. 5A is a cross-sectional view of the foldable and collapsible safe box mounted on a residence front door.

FIG. 5A illustrates an elongated mounting bracket plate 100 which extends substantially the entire thickness of the front door 130 to secure the box body 10 by sliding the bracket 100 under the front door 130. The outer gripping flange 90 of the mounting bracket plate 100 may also be fastened to the front wall panel of the box body 10 through the use of bolts 120. It should be readily apparent to those skilled in the art that other known types of fastening means such as rivets or pivots could also be used.

Figure 5B:
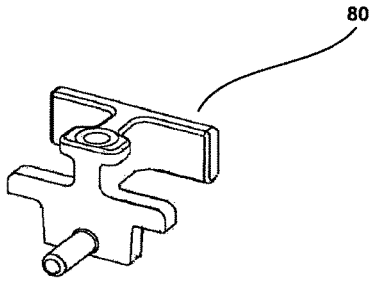
FIG. 5B is a perspective view of the spring loaded hinge constructed according to an embodiment of the present invention.

FIG. 5B is the spring loaded latch 80 used to attach the bottom panel 70 to the back wall 60 shown in FIG. 2.

The mounting base plate 100 is substantially U-shaped. The dimensions of the mounting bracket plate are chosen so that the same fits snugly under the bottom edge of a standard front door 130 as shown in FIGS. 5A and 6. When the front door 130 and the mounting bracket plate 100 are assembled by sliding the mounting bracket plate 100 under the front door 130 as shown in FIG. 5A, the inner gripping flange 110 of the mounting bracket plate 100 stays inward of the front door 130 to mount the box body 10 to the front door 130.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

Having illustrated and described the principles of the present invention in a preferred embodiment, it will be apparent to those skilled in the art that the embodiment can be modified in arrangement and detail without departing from such principles. Any and all such embodiments are intended to be included within the scope of the following claims.

What is claimed is:

1. A foldable and collapsible safe box for securing packages or parcels comprising:

(a) a collapsible box body foldable between a collapsed configuration and an expanded configuration defining an interior volume for receiving the packages or parcels:

(b) a plurality of upright support hinges;

(c) a flap top connected to the collapsible box body by double hinges;

(d) a bottom panel connected to the collapsible box by double hinges and having at least one spring loaded latch for securing the bottom panel to the box body and for holding the box body in the expanded configuration; and (e) a U-shaped elongated mounting bracket plate having an outer flange and an inner flange defining a channel there between, the outer flange attached to a front side panel of the box body with a fastener and the inner flange positioned against the inside of a door when the plate is slidably engaged under the door.

2. The foldable and collapsible safe box as claimed in claim 1, wherein the collapsible box body is formed of plastic, metal, or any material suitable.

3. The foldable and collapsible safe box as claimed in claim 1, wherein the collapsible box body includes at least four vertical peripheral side panels.

4. The foldable and collapsible safe box as claimed in claim 1, wherein the upright support hinges are respectively embedded in the four corners of the collapsible box body.

5. The foldable and collapsible safe box as claimed in claim 1, wherein, when the door is closed, the mounting bracket plate holds the box body closely adjacent the door and cannot be removed from the door.

6. The foldable and collapsible safe box as claimed in claim 1, wherein the fastener is selected from a group consisting of bolts, screws, pivots, and any combination thereof.

* * * * *